US005780218A

United States Patent [19]

Mifune et al.

[11] Patent Number: 5,780,218

[45] Date of Patent: Jul. 14, 1998

[54] REDUCTION SENSITIZATION METHOD OF SILVER HALIDE PHOTOGRAPHIC EMULSION AND SILVER HALIDE PHOTOGRAPHIC MATERIAL CONTAINING THE REDUCTION SENSITIZED SILVER HALIDE PHOTOGRAPHIC EMULSION

[75] Inventors: Hiroyuki Mifune; Tetsuro Kojima; Yasuhiro Mitamura, all of Kanagawa, Japan

[73] Assignee: Fuji Photo Film Co., Ltd., Kanagawa, Japan

[21] Appl. No.: 627,548

[22] Filed: Apr. 4, 1996

[30] Foreign Application Priority Data

Apr. 4, 1995 [JP] Japan ..... 7-078685

[51] Int. Cl.[6] ..... G03C 1/08

[52] U.S. Cl. ..... 430/599; 430/600; 430/603

[58] Field of Search ..... 430/599, 600, 430/603

[56] References Cited

U.S. PATENT DOCUMENTS

| | | | |
|---|---|---|---|
| 3,615,615 | 10/1971 | Lincoln et al. | 430/614 |
| 4,971,889 | 11/1990 | Ikeda et al. | 430/264 |
| 4,985,351 | 1/1991 | Matejec et al. | 430/599 |
| 5,459,025 | 10/1995 | Hioki | 430/570 |
| 5,538,843 | 7/1996 | Hioki et al. | 430/614 |
| 5,556,741 | 9/1996 | Suga et al. | 430/569 |
| 5,573,901 | 11/1996 | Yamashita et al. | 430/567 |
| 5,578,440 | 11/1996 | Hioki et al. | 430/581 |

FOREIGN PATENT DOCUMENTS

| | | | |
|---|---|---|---|
| 0348934 | 1/1990 | European Pat. Off. | G03C 1/06 |
| 0369491 | 5/1990 | European Pat. Off. | G03C 1/015 |

*Primary Examiner*—Mark F. Huff

*Attorney, Agent, or Firm*—Birch, Stewart, Kolasch & Birch, LLP

[57] ABSTRACT

A method of reduction sensitization to provide a low-fog and high-speed silver halide emulsion having satisfactory preservability and a silver halide photographic material containing a silver halide emulsion having been reduction sensitized by the method are disclosed, the reduction sensitization being carried out using a compound having a group which is capable of being adsorbed onto a silver halide and a reducing group or a precursor of that compound during silver halide grain formation or after completion of grain formation.

8 Claims, No Drawings

REDUCTION SENSITIZATION METHOD OF SILVER HALIDE PHOTOGRAPHIC EMULSION AND SILVER HALIDE PHOTOGRAPHIC MATERIAL CONTAINING THE REDUCTION SENSITIZED SILVER HALIDE PHOTOGRAPHIC EMULSION

FIELD OF THE INVENTION

This invention relates to a reduction sensitization method of a silver halide photographic emulsion. More particularly, it relates to a method of reduction sensitization which provides a silver halide photographic emulsion with increased sensitivity, reduced fog and improved preservability, and to a silver halide photographic material containing a silver halide emulsion prepared by the reduction sensitization.

BACKGROUND OF THE INVENTION

In recent years, it has been increasingly desired for silver halide photographic materials with improved photographic properties, such as sensitivity, graininess, gradation, sharpness, preservability, and suitability to rapid processing especially of development. In particular, the demands for improving preservability while minimizing fog and for further increasing sensitivity are strong.

Reduction sensitization has conventionally been studied for increasing sensitivity. Reduction sensitizers which have been proved useful for reduction sensitization of silver halide emulsions include stannous chloride (U.S. Pat. No. 2,487,850), polyamines or cyclic amine compounds (U.S. Pat. Nos. 2,518,698, 2,521,925 and 3,930,867), thiourea dioxide (aminoiminomethanesulfinic acid) type compounds (British patent 789,823 and U.S. Pat. No. 2,983,609 and 2,983,610), borane compounds (U.S. Pat. Nos. 3,779,777, 3,782,959, and 4,150,093), and ascorbic acid (EP 369491A). A comparative study of the silver nuclei formed by various reduction sensitization methods is described in Collier, *Photographic Science and Engineering*, Vol. 23, p. 113 (1979), in which the author uses dimethylamine borane, stannous chloride, and hydrazine as reduction sensitizers and adopts a high pH ripening method and a low pAg ripening method. Reduction sensitization generally tends to cause noticeable fog when combined with gold sensitization, and a reduction sensitized emulsion has particularly poor preservability. In order to eliminate these disadvantages, not only choice of a reduction sensitizer but manipulation of reduction sensitization have been studied. Studies have been directed particularly to the stage of conducting reduction sensitization. Through the reduction sensitization was carried out after formation of silver halide grains in most of the above-cited patents, reduction sensitization during formation of silver halide grains has been attempted for example, in JP-A-48-87825 (the term "JP-A" as used herein means an "unexamined published Japanese patent application"), JP-A-50-3619, EP 348934A, EP 369491A, EP 371338A, and EP 435355A.

Since these techniques still use the above-described well-known reduction sensitizers at the time of silver halide grain formation, unnecessary fog silver nuclei tend to be formed simultaneously. Therefore, it has been necessary to use in combination an oxidizing agent, such as thiosulfonic acid or iodine, in order to suppress fog silver nuclei formation and to improve preservability of the emulsion as proposed in some of the above patents.

However, such a compound which oxidizes silver nuclei is used in a large amount, the sensitivity once increased by reduction sensitization is reduced if used in a large amount. If the compound is used in a small amount, improvement of preservability and prevention of fog become insufficient.

Further, a by-product resulting from oxidation reaction or the residue of the oxidizing agent often causes defects.

Accordingly, it has been keenly demanded to develop a method of reduction sensitization which provides a silver halide emulsion of low fog and satisfactory preservability while using no or a small amount of an oxidizing agent in combination.

SUMMARY OF THE INVENTION

An object of the present invention is to provide a method of reduction sensitization for obtaining a high-speed silver halide photographic emulsion.

Another object of the present invention is to provide a method of reduction sensitization for obtaining a low-fog, highly preservative, and high-speed silver halide photographic emulsion.

A further object of the present invention is to provide a silver halide photographic material containing a low-fog and high-speed silver halide emulsion.

The above objects of the invention have been accomplished by a method of reduction sensitization of a silver halide photographic emulsion, which comprises using a compound having a group which is capable of being adsorbed onto a silver halide (hereinafter simply referred to as an adsorbable group) and a reducing group or a precursor of the compound.

DETAILED DESCRIPTION OF THE INVENTION

The compound having an adsorbable group and a reducing group which can be used in the present invention includes those represented by formula (I):

$$A—(W)_n—R \qquad (I)$$

wherein A represents an atomic group containing a group capable of being adsorbed onto a silver halide; W represents a divalent linking group; n represents 0 or 1; and R represents a reducing group.

Examples of the atomic group A containing the adsorbable group includes a mercapto compound (e.g., a mercaptotetrazole group, a mercaptotriazole group, a mercaptoimidazole group, a mercaptothiadiazole group, mercaptoxadiazole group, a mercaptobenzothiazole group, a mercaptobenzoxazole group, a mercaptobenzimidazole group, a mercaptotetraazaindene group, a mercaptopyridyl group, a mercaptoalkyl group, and amercaptophenyl group); a thione compound (e.g., a thiazoline-2-thione group, an imidazoline-2-thione group, a benzimidazoline-2-thione group, benzothiazoline-2-thione group, a thiourea group, and a thioamido group); a compound forming imino silver (e.g., a benzotriazole group, a tetrazole group, a hydroxytetraazaindene group, and a benzimidazole group). Among those, mercapto compounds and thione compounds are preferred.

The divalent linking group W is composed of a hydrogen atom, an oxygen atom, a nitrogen atom, and a sulfur atom. Examples of W are an alkylene group having 1 to 20 carbon atoms (e.g., methylene, ethylene, trimethylene, tetramethylene or hexamethylene), an arylene group having 6 to 20 carbon atoms (e.g., phenylene or naphthylene), $—CONR_1—$, $—SO_2NR_2—$, $—O—$, $—S—$, $—NR_3—$, $—NR_4CO—$, $—NR_5SO_2—$, $—NR_6CONR_7—$, $—COO—$, and —OCO—, provided that any combination of these groups may be taken together to form a divalent linking group, wherein $R_1$, $R_2$, $R_3$, $R_4$, $R_5$, $R_6$, and $R_7$ each represent a hydrogen atom, an aliphatic group or an aromatic group.

The aliphatic groups represented by $R_1$, $R_2$, $R_3$, $R_4$, $R_5$, $R_6$, and $R_7$ preferably include those having 1 to 30 carbon atoms, more preferably straight-chain, branched or cyclic alkyl, alkenyl, alkynyl or aralkyl groups having 1 to 20 carbon atoms. Examples of the alkyl, alkenyl, alkynyl or aralkyl groups are methyl, ethyl, isopropyl, t-butyl, n-octyl, n-decyl, n-hexadecyl, cyclopropyl, cyclopentyl, cyclohexyl, allyl, 2-butenyl, 3-pentenyl, propargyl, 3-pentynyl and benzyl groups.

The aromatic groups represented by $R_1$, $R_2$, $R_3$, $R_4$, $R_5$, $R_6$, and $R_7$ preferably include those having 6 to 30 carbon atoms, more preferably monocyclic or condensed aryl group having 6 to 20 carbon atoms, such as a phenyl group and a naphthyl group.

The reducing group R is not limited as far as it is a functional group capable of reducing a silver halide. Examples of R include a formyl group, an amino group, an acetylene group, and a hydrazino group, with a formyl group, an amino group, and a hydrazino group being preferred.

The precursor of the compound having an adsorbable group and a reducing group is a compound capable of releasing the compound of formula (I), including a compound producing an adsorbable mercapto group and a reducing formyl group on hydrolysis, such as a thiazolium compound (including a benzothiazolium compound and a napahthothiazolium compound), a thiazoline compound, and a thiazolidine compound (Compound 13 hereinafter given is an example of this type), and a reducing group-containing disulfide compound producing an adsorbable mercapto group on cleavage of the disulfide linkage.

Specific examples of the compound represented by formula (I) are shown below only for illustrative purposes but not for limitation.

1.
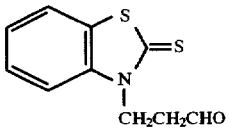

2.
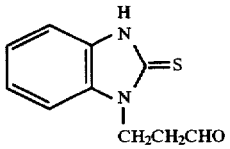

3.
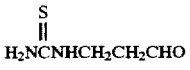

4.
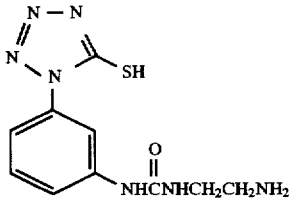

5.
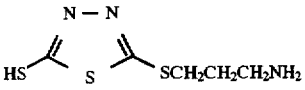

6.
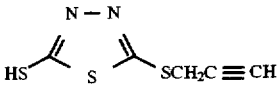

7.
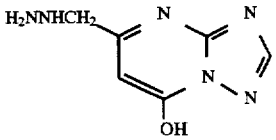

8.
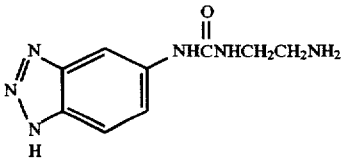

9.
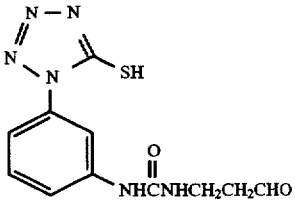

10.
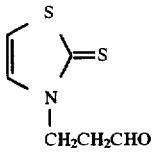

11.
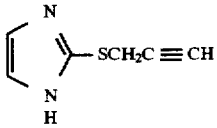

12.
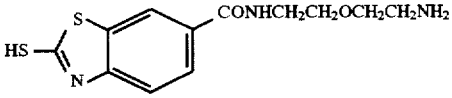

13.
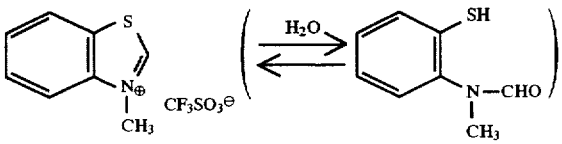

14.
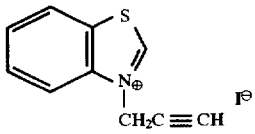

-continued

15.

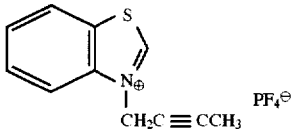

16.

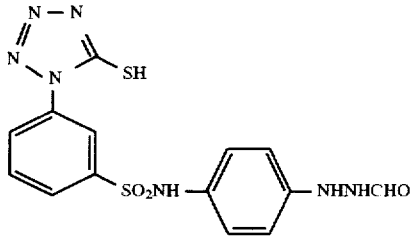

17.

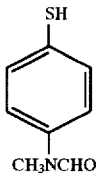

18.

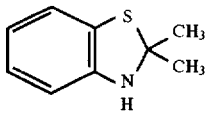

19.

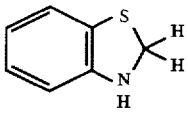

20.

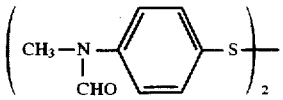

21.

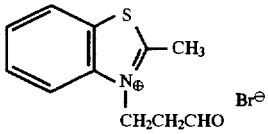

22.

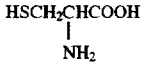

23.

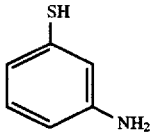

24.

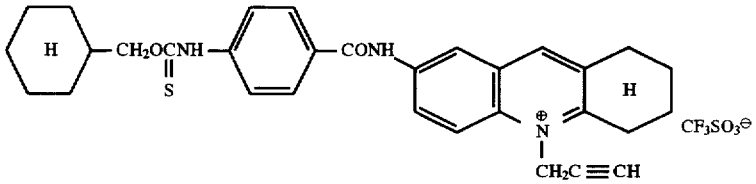

Production of a silver halide emulsion is divided into steps of grain formation, desalting, chemical sensitization, and the like. The step of grain formation is further divided into nucleation, ripening, growth, and the like. The number or order of these steps is not fixed, and the above listed order may be reversed, or some step may be repeated. Reduction sensitization of a silver halide emulsion may be carried out either during the chemical sensitization or in any of the preceding steps. That is, reduction sensitization can be conducted at any stage of the grain formation step, i.e., nucleation, physical ripening or grain growth, or before chemical sensitization (note that the terminology "chemical sensitization" as used herein is intended to mean chemical sensitization except reduction sensitization). Where gold sensitization is carried out as chemical sensitization, it is preferred that reduction sensitization precedes the chemical sensitization so as to prevent unfavorable fog.

While the reduction sensitization of the present invention can be performed either during or after grain formation, "during grain formation" is preferred. What is meant by "during grain formation" includes a mode in which silver halide grains are subjected to reduction sensitization while they are physically ripened or are growing under addition of a water-soluble silver salt and a water-soluble alkali halide and a mode in which growth of the grains is temporarily stopped to conduct reduction sensitization, followed by resumption of the grain growth.

Where reduction sensitization is carried out during grain formation, the time of adding a reduction sensitizer is selected from before the start of grain formation to immediately before the completion of grain formation so that silver nuclei may be formed inside the grains. It is particularly recommended to conduct reduction sensitization after the completion of silver halide nucleation, i.e., after 5 to 99%, particularly 10 to 98%, of the total silver amount to be used has been consumed. The reduction sensitizer may be added continuously or in two or more divided portions.

While varying depending on the kind of silver halide grains to be sensitized or the conditions of reduction sensitization, the reduction sensitizer is used in an amount usually of from $1\times10^{-8}$ to $1\times10^{-2}$ mol, preferably of from $1\times10^{-7}$ to $1\times10^{-3}$ mol, per mol of silver halide.

While not limiting, the reduction sensitization is carried out under conditions of generally 5 to 11, preferably 6 to 10, in pAg; generally 3 to 10, preferably 4 to 8, in pH; and generally 40° to 95° C., preferably 45° to 85° C., in temperature.

The compound of formula (I) may be dissolved or dispersed in water or a water-miscible organic solvent which is appropriately selected from among alcohols, glycols, ketones, esters, amides, and the like so as not to give an adverse influence on the photographic properties, and added in the form of a solution or a solid dispersion.

In the present invention, a silver oxidizing agent, such as a thiosulfonate, iodine or a dichalcogen compound, may be used in combination as long as such does not impair the effects of the present invention.

As mentioned with respect to conventional techniques, reduction sensitizers hitherto employed carry no functional group which actively takes the action of "being adsorbed" on silver halide. The greatest feature of the reduction sensitizer of the present invention, which is essential for manifestation of the aimed effects, resides in that it always has a functional group which is actively adsorbed on silver halide. It seems that, after the reducing group forms silver nuclei, the compound keeps adsorbed onto the vicinities of the silver nuclei to serve as a hindrance for the silver nuclei to grow to large nuclei, i.e., fog silver nuclei, and also tends to serve to protect the silver nuclei formed on the grain surface. As a result, a reduction sensitized silver halide emulsion having improved preservability can be obtained using no or little amount of an oxidizing agent in combination.

Some of the reducing agents having an adsorbable group and a reducing group in the present invention are known as a nucleating agent for direct reversal materials or a contrast-increasing agent. However, they have been incorporated into a silver halide light-sensitive material so as to manifest their reducing activity mainly at the time of development for the purpose of fogging the silver halide or of effecting nucleation development. That is, the purpose and method of use of these reducing agents as intended in the conventional techniques are utterly different from those of the present invention. It is not at all intended in the present invention that the reduction sensitizer used manifests its effects at the time of development.

What is intended in the present invention consists in achievement of reduction sensitization by which silver nuclei, sensitization centers, be previously formed in silver halide grains before exposure.

It is preferable that the silver halide photographic emulsion having undergone reduction sensitization according to the present invention be further subjected to chalcogen sensitization, such as sulfur sensitization, selenium sensitization or tellurium sensitization, and noble metal sensitization, either individually or as a combination thereof.

Sulfur sensitization can be carried out by using a labile sulfur compound, for example, the compound described in P. Grafkides, *Chimie et Physique Photographique,* 5th Ed., Paul Montel (1987) or *Research Disclosure*, No. 307, No. 307105.

Examples of usable labile sulfur compounds include thiosulfates (e.g., Hypo), thioureas (e.g., diphenylthiourea, triethylthiourea, N-ethyl-N'-(4-methyl-2-thiazolyl)thiourea, and carboxymethyltrimethylthiourea), thioamides (e.g., thioacetamide), rhodanines (e.g., diethyl rhodanine and 5-benzylidene-N-ethyl rhodanine), phosphine sulfides (e.g., trimethylphosphine sulfide), thiohydantoins, 4-oxo-oxazolidine-2-thiones, di- or polysulfides (e.g., dimorpholine disulfide, cystine, and hexathiepane), polythionates, and active gelatin.

Selenium sensitization can be carried out by using a labile selenium compound. Suitable labile selenium compounds are described in JP-B-43-13489 (the term "JP-B" as used herein means an "examined published Japanese patent publication"), JP-B-44-15748, JP-A-4-25832, JP-A-4-109340, JP-A-4-271341, JP-A-5-40324, JP-A-5-11385, JP-A-6-51415, JP-A-6-175258, JP-A-6-180478, JP-A-6-208186, JP-A-6-208184, JP-A-6-317867, JP-A-7-92599, JP-A-7-98483 and JP-A-7-140579.

Examples of the labile selenium compounds include colloidal metallic selenium, selenoureas (e.g., N,N-dimethylselenourea, trifluoromethylcarbonyl-trimethylselenourea, and acetyl-trimethylselenourea), selenoamides (e.g., selenoamide and N,N-diethylphenylselenoamide), phosphine selenides (e.g., triphenylphosphine selenide and pentafluorophenyl-triphenylphosphine selenide), selenophosphates (e.g., tri-p-tolyl selenophosphate and tri-n-butyl selenophosphate), selenoketones (e.g., selenobenzophenone), isoselenocyanates, selenocarboxylic acids, selenoesters, and diacyl selenides. Non-labile selenium compounds disclosed in JP-B-46-4553 and JP-B-52-34492, such as selenious acid, potassium selenocyanate, selenazoles, and selenides, may also be used.

Tellurium sensitization can be carried out by using a labile tellurium compound. Suitable labile tellurium compounds are described in JP-A-4-224595, JP-A-4-271341, JP-A-4-333043, JP-A-5-303157, JP-A-6-27573, JP-A-6-175258, JP-A-6-180478, JP-A-6-208186, JP-A-6-208184, JP-A-6-317867 and JP-A-7-140579.

Examples of the labile tellurium compounds include phosphine tellurides (e.g., butyldiisopropylphosphine telluride, tributylphosphine telluride, tributoxyphosphine telluride, and ethoxydiphenylphosphine telluride), diacyl (di)tellurides (e.g., bis(diphenylcarbamoyl) ditelluride, bis (N-phenyl-N-methylcarbamoyl) ditelluride, bis(N-phenyl-N-methylcarbamoyl) telluride, bis(N-phenyl-N-benzylcarbamoyl) telluride, and bis(ethoxycarbonyl) telluride), telluroureas (e.g., N,N'-dimethylethylenetellurourea and N,N'-diphenylethylenetellurourea), telluroamides, and telluroesters.

Noble metal sensitization can be carried out by using salts of noble metals, such as gold, platinum, palladium, and iridium, described in P Grafkides, *Chimie et Physique Photographique,* 5th Ed., Paul Montel (1987) and *Research Disclosure*, Vol. 307, No. 307105. Gold sensitization is preferred. Examples of gold sensitizers include chloroauric acid, potassium chloroaurate, potassium aurothiocyanate, gold sulfide, gold selenide and, in addition, the gold compounds described in U.S. Pat. Nos. 2,642,361, 5,049,484, 5,049,485, 5,169,751, and 5,252,455, and Belgian Patent 691,857.

These chemical sensitization techniques may be used as a combination of two or more thereof. In this case, a combination of chalcogen sensitization and gold sensitization, for example, gold-sulfur sensitization, gold-sulfur-selenium sensitization, gold-sulfur-tellurium sensitization, or gold-sulfur-selenium-tellurium sensitization, is preferred.

The amount of the chemical sensitizer to be used is usually $1\times10^{-8}$ to $1\times10^{-2}$ mol, preferably $1\times10^{-7}$ to $1\times10^{-3}$ mol, per mol of silver halide, while varying depending on the kind of silver halide grains to be sensitized and the condition of chemical sensitization.

While not limiting, the chemical sensitization is carried out under conditions of generally 6 to 11, preferably 7 to 10, in pAg; generally 4 to 10, preferably 5 to 8, in pH; and generally 40° to 95° C., preferably 45° to 85° C., in temperature.

The chemical sensitization is preferably carried out in the presence of a silver halide solvent.

Examples of suitable silver halide solvents include thiocyanates (e.g., potassium thiocyanate), thioether compounds (e.g., those described in U.S. Pat. Nos. 3,021,215 and 3,271,157, JP-B-58-30571, and JP-A-60-136736, especially 3,6-dithia-1,8-octanediol), tetra-substituted thiourea compounds (e.g., those described in JP-B-59-11892 and U.S. Pat. No. 4,221,863, especially tetramethylthiourea), the thione compounds described in JP-B-60-1134, the mercapto compounds described in JP-B-63-29727, the meso-ion compounds described in JP-A-60-163042, the selenoether compounds described in U.S. Pat. No. 4,782,013, the telluroether compounds described in JP-A-2-118566, and sulfites. Preferred of them are thiocyanates, thioether compounds, tetra-substituted thiourea compounds, and thione compounds. Thiocyanates are particularly preferred. The silver halide solvent is usually used in an amount of about $1\times10^{-5}$ to $1\times10^{-2}$ mol per mol of silver halide.

The silver halide emulsions to be reduction sensitized by the method of the present invention and silver halide photographic materials (sometimes referred to as light-sensitive materials) containing the thus sensitized silver halide emulsion is described below.

The silver halide photographic materials are photographic materials comprising a support having thereon a silver halide emulsion layer.

The silver halide used in the present invention preferably includes silver bromide, silver iodobromide, silver iodochlorobromide, silver chlorobromide, and silver chloride.

The silver halide grains may have a regular crystal form, such as a cubic form or an octahedral form; an irregular crystal form, such as a spherical form or a tabular form, or a composite form thereof. A mixture of various crystal forms may also be used. Grains of regular crystal form are preferred.

The silver halide grains may be homogeneous throughout the individual grains or may comprise an inside phase and an outer phase having different silver halide composition. Heterogeneous grains (i.e., multiple-structured grains) having two or more layers different in iodine content, particularly those having a higher iodine content in the inside are also preferred. The grains may be of surface latent image type (grains in which a latent image is formed predominantly on the surface thereof, e.g., negative type emulsion grains) or of internal latent image type (grains in which a latent image is formed predominantly in the inside thereof, e.g., previously fogged direct reversal type emulsion grains). Surface latent image type emulsion grains are preferred. Further, grains having dislocation lines are preferred.

The silver halide emulsion used in the present invention contains tabular silver halide grains having an aspect ratio of not less than 3, preferably from 3 to less than 8. It is desirable for the silver halide emulsion to comprise such tabular grains in a proportion of not less than 60% based on the total projected area.

The tabular grains as referred to above preferably have a diameter of 0.15 to 5.0 μm and a thickness of 0.05 to 1.0 μm.

An average aspect ratio of tabular grains is obtained as an arithmetic mean of the aspect ratios of individual grains in at least 100 silver halide grains. It is also obtained as a ratio of an average grain diameter to an average grain thickness.

In using normal crystal grains or spherical or cubic crystal grains, those having a diameter of generally 0.05 to 3 μm, preferably 0.08 to 2 μm, are used. Mono-dispersed emulsions having a variation coefficient of grain size distribution of generally not more than 20%, particularly not more than 15%, are preferred.

The main plane of the tabular grains may be a (111) face or a (100) face.

Use of mono-dispersed tabular grain emulsions gives better results. The structure of mono-dispersed tabular grain emulsions and the process for preparing them are described in JP-A-63-151618, etc. In brief, the term "mono-dispersed tabular grain emulsion" as referred to herein is intended to mean an emulsion in which at least 70% of the total projected area of the silver halide grains is occupied by tabular grains having a pair of hexagonal planes as main outer surfaces which are facing to each other in parallel, each having a ratio of its longest side length to its shortest side length of 2 or less, the emulsion having a degree of mono-dispersion of not more than 20% as expressed in terms of variation coefficient of grain size distribution (a quotient obtained by dividing a standard deviation of grain size, expressed in terms of circle-equivalent diameter of the projected area, by a mean grain size).

The emulsion grains preferably have dislocation lines. Dislocation of tabular grains can be observed directly under a transmission electron microscope at a low temperature as described, e.g., in J. F. Hamilton, *Phot. Sci. Eng.*, Vol. 11, p. 57 (1967) and T. Shiozawa, *J. Soc. Phot. Sci. Japan*, Vol. 35, p. 213 (1972).

A silver halide solvent can be used in the formation of silver halide grains in order to control the grain growth. Examples of suitable silver halide solvents include ammonia, potassium thiocyanate, ammonium thiocyanate, thioether compounds (e.g., the compounds described in U.S. Pat. Nos. 3,271,157, 3,574,628, 3,704,130, 4,297,439, and 4,276,374), thione compounds (e.g., the compounds described in JP-A-53- 144319, JP-A-53-82408, and JP-A-55-77737), and amine compounds (e.g., the compounds described in JP-A-54-100717).

A ruthenium salt, a zinc salt, a chromium salt, an iridium salt or a complex salt thereof, a rhodium salt or a complex salt thereof, or an iron salt or a complex salt thereof may be present in the grain formation system or physical ripening system. In particular, an iridium salt, an iron salt or a rhodium salt is preferred.

Gelatin is advantageously used as a binder or a protective colloid in photographic emulsion layers or intermediate layers. Other hydrophilic colloids may also be used as well. Examples of usable hydrophilic colloids are proteins such as gelatin derivatives, graft polymers of gelatin with other high polymers, albumin, and casein; cellulose derivatives such as hydroxyethyl cellulose, carboxymethyl cellulose, and cellulose sulfate; sugar derivatives such as sodium alginate and starch derivatives; and a variety of synthetic hydrophilic high polymers such as polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc. and copolymers comprising monomers constituting these homopolymers.

The tabular grains used in the present invention can be prepared by known processes described, e.g., in Cleve, *Photography Theory and Practice*, p. 131 (1930), Gutoff, *Photographic Science and Engineering*, Vol. 14, pp. 248–257 (1970), U.S. Pat. Nos. 4,434,226, 4,414,310, 4,433,048, and 4,439,520, and British Patent 2,112,157.

Examples of gelatin which can be used in the present invention include lime-processed gelatin, acid-processed gelatin, enzyme-processed gelatin as described in *Bull. Soc. Sci. Phot. Japan*, No. 16, p. 30 (1966), and hydrolysis products of gelatin.

An organic or inorganic hardening agent may be incorporated into any hydrophilic colloidal layer constituting a photographic light-sensitive layer or a backing layer of the photographic material of the present invention. Examples of suitable hardening agents include chromium salts, aldehyde salts (e.g., formaldehyde, glyoxal, and glutaraldehyde), and N-methylol compounds (e.g., dimethylolurea). Active halogen compounds (e.g., 2,4-dichloro-6-hydroxy-1,3,5-triazine or a sodium salt) and active vinyl compounds (e.g., 1,3-bisvinylsulfonyl-2-propanol, 1,2-bis(vinylsulfonylacetamido)ethane, bis(vinylsulfonylmethyl) ether, and vinyl polymers having a vinylsulfonyl group in the side chain thereof) are preferred; since they rapidly harden hydrophilic colloids, such as gelatin, to give stable photographic characteristics. N-Carbamoylpyridinium salts (e.g., (1-morpholinocarbonyl-3-pyridinio) methanesulfonate) and haloamidinium salts (e.g., 1-(1-chloro-1-pyridinomethylene)pyrrolidinium-2-naphthalenesulfonate) also harden hydrophilic colloids rapidly.

The silver halide photographic emulsions are preferably spectrally sensitized with methine dyes and the like. Examples of the dyes include cyanine dyes, merocyanine dyes, complex cyanine dyes, complex merocyanine dyes, holopolar cyanine dyes, hemicyanine dyes, styryl dyes, and hemioxonol dyes. Cyanine dyes, merocyanine dyes and complex merocyanine dyes are particularly preferred. Any of nuclei commonly employed in cyanine dyes as a basic heterocyclic nucleus is applicable to these dyes. Included in such nuclei are pyrroline, oxazoline, thiazoline, pyrrole, oxazole, thiazole, selenazole, imidazole, tetrazole, and pyridine nuclei; the above-enumerated nuclei to which an alicyclic hydrocarbon ring is fused; and the above-enumerated nuclei to which an aromatic hydrocarbon ring is fused, e.g., indolenine, benzindolenine, indole, benzoxazole, naphthoxazole, benzothiazole, naphthothiazole, benzoselenazole, benzimidazole, and quinoline nuclei. These nuclei may have a substituent(s) on the carbon atom(s) thereof.

To merocyanine dyes or complex merocyanine dyes is applicable a 5- or 6-membered heterocyclic ring as a nucleus having a ketomethylene structure, e.g., pyrazolin-5-one, thiohydantoin, 2-thiooxazolidine-2,4-dione, thiazolidine-2,4-dione, rhodanine, and thiobarbituric acid nuclei.

These sensitizing dyes may be used either individually or in combination thereof. Combinations of sensitizing dyes are often used for the purpose of supersensitization. Photographic emulsions may contain a compound which exhibits no spectral sensitizing effect by itself or absorbs no substantial visible light but which shows supersensitizing effect when combined with a sensitizing dye. For example, the emulsion may contain an aminostilbene compound substituted with a nitrogen-containing heterocyclic ring (e.g., the compounds described in U.S. Pat. Nos. 2,933,390 and 3,635,721), an aromatic organic acid-formaldehyde condensate (e.g., the compounds described in U.S. Pat. No. 3,743,510), a cadmium salt, or an azaindene compound. The combinations described in U.S. Pat. Nos. 3,615,613, 3,615,641, 3,617,295, and 3,635,721 are particularly useful.

For prevention of fog during preparation, preservation or photographic processing of a light-sensitive material or for stabilization of photographic properties of a light-sensitive material, various compounds can be introduced into the photographic emulsion of the invention. Examples of such the compounds include azoles, such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazles, and mercaptotetrazoles (especially 1-phenyl-5-mercaptotetrazoles); mercaptopyrimidines; mercaptotriazines; thioketo compounds, such as oxazolinethione; azaindenes, such as triazaindenes, tetraazaindenes (especially 4-hydroxy-6-methyl(1,3,3a,7)tetraazaindene), and pentaazaindenes; benzenethiosulfonic acids; benzenesulfinic acids; benzenesulfonamides; and many other compounds known as antifoggants or stabilizers.

The silver halide photographic material may contain one or more surface active agents for the purpose of coating aid, electrification prevention, improvement of sliding properties, improvement of emulsification and dispersion, prevention of adhesion, and improvement of photographic characteristics (e.g., acceleration of development, high contrast, and sensitization).

The silver halide photographic material may further contain in its hydrophilic colloidal layers a water-soluble dye as a filter dye, or for prevention of irradiation or halation, or for various other purposes. Oxonol dyes, hemioxonol dyes, styryl dyes, merocyanine dyes, anthraquinone dyes, and azo dyes are preferably used. Cyanine dyes, azomethine dyes, triarylmethane dyes and phthalocyanine dyes are also useful. An oil-soluble dye may be to a hydrophilic colloidal layer according to the oil-in-water dispersion method.

The photographic material includes multilayered multicolor light-sensitive materials comprising a support having at least two layers different in spectral sensitivity.

Multilayered multicolor light-sensitive materials comprise a support having thereon at least one red-sensitive emulsion layer, at least one green-sensitive emulsion layer, and at least one blue-sensitive emulsion layer. The order of these emulsion layers is arbitrary. A preferred order is red-sensitive/green-sensitive/blue-sensitive layer, blue-sensitive/green-sensitive/red-sensitive layers, or blue-sensitive/red-sensitive/green-sensitive layers from the support side. An emulsion layer having the same color sensitivity may consist of two or more emulsion layers having different sensitivities to elevate the ultimate sensitivity, or may consist of three layers to further improve graininess. A light-insensitive layer may be provided between two or more emulsion layers having the same color sensitivity. Emulsion layers having the same color sensitivity may be interposed therebetween an emulsion layer of different color sensitivity. A reflective layer comprising fine silver halide grains may be provided under a high-speed emulsion layer, particularly a high-speed blue-sensitive layer, to further improve the sensitivity.

Photographic additives which can be used in the silver halide emulsion of the present invention are described in *Research Disclosure* Nos. 17643 (Dec., 1978), 18716 (November, 1979), and 30710 (Nov., 1989) as shown below. In the Table RD stands for *Research Disclosure*, and RC and LC stand for right column and left column, respectively.

| Additive | RD 17643 | RD 18716 | RD 307105 |
|---|---|---|---|
| 1. Chemical Sensitizer | p. 23 | p. 648, RC | p. 866 |
| 2. Sensitivity Increasing Agent | | do. | |
| 3. Spectral Sensitizer, Supersensitizer | pp. 23–24 | p. 648, RC to p. 649, RC | pp. 866–868 |
| 4; Brightening Agent | p. 24 | p. 647, RC | p. 868 |
| 5. Antifoggant, Stabilizer | pp. 24–25 | p. 649, RC | pp. 868–870 |
| 6. Light Absorber, Filter Dye, Ultraviolet Absorber | pp. 25–26 | p. 649, RC to P. 650, LC | p. 873 |
| 7. Stain inhibitor | p. 25, RC | p. 650, LC to RC | p. 872 |
| 8. Dye image stabilizer | p. 25 | p. 650, LC | p. 872 |
| 9. Hardening agent | p. 26 | p. 651, LC | pp. 874–875 |
| 10. Binder | p. 26 | p. 651, LC | pp. 873–874 |
| 11. Plasticizer, Lubricant | p. 27 | P. 650, RC | p. 876 |

-continued

| Additive | RD 17643 | RD 18716 | RD 307105 |
|---|---|---|---|
| 12. Coating Aid, Surface Active Agent | pp. 26–27 | p. 650, RC | pp. 875–876 |
| 13. Antistatic Agent | p. 27 | do. | pp. 876–877 |
| 14. Matting Agent | | | pp. 878–879 |

The details of other techniques and other organic and inorganic materials which can be used in the silver halide photographic emulsions of the present invention are described in EP 436,938A2 and other publications as shown below.

| | EP 436938A2 | Others |
|---|---|---|
| 1) Layer structure | p. 146, 1. 34 to p. 147, 1. 25 | |
| 2) Yellow coupler | p. 137, 1. 35 to p. 146, 1. 33, p. 149, 11. 21–23 | |
| 3) Magenta coupler | p. 149, 11. 24–28 | EP 421453A1, p. 3, 1. 5 to p. 25, 1. 55 |
| 4) Cyan coupler | p. 149, 11. 29–33 | EP 432804A2, p. 3, 1. 28 to p. 40, 1. 2 |
| 5) Polymer coupler | p. 149, 11. 34–38 | EP 435334A2, p. 113, 1. 39 to p. 123, 1. 37 |
| 6) Colored coupler | p. 53, 1. 42 to p. 137, 1. 34, p. 149, 11. 39–45 | |
| 7) Other functional couplers | p. 7, 1. 1 to p. 53, 1. 41, p. 149, 1. 46 to p. 150, 1. 3 | EP 435334A2, p. 3, 1. 1 to p. 29, 1. 50 |
| 8) Antiseptics and antifungals | p. 150, 11. 25–28 | |
| 9) Formalin scavenger | p. 149, 11. 15–17 | |
| 10) Other additives | p. 153, 11. 38–47 | EP 421453A1, p. 75, 1. 21 to p. 84, 1. 56, p. 27, 1. 40 to p. 37, 1. 40 |
| 11) Dispersing method | p. 150, 11. 4–24 | |
| 12) Support | p. 150, 11. 32–34 | |
| 13) Film thickness, film properties | p. 150, 11. 35–49 | |
| 14) Color development | p. 150, 1. 50 to p. 151, 1. 47 | |
| 15) Desilvering | p. 151, 1. 48 to p. 152, 1. 53 | |
| 16) Automatic processor | p. 152, 1. 54 to p. 153, 1. 2 | |
| 17) Washing and stabilization | p. 153, 11. 3-37 | |

Preferred embodiment of the present invention are as follows.

1) A method of reduction sensitization of a silver halide photographic emulsion comprising using a compound having an adsorbable group and a reducing group or a precursor of the compound.
2) A method of (1) above, in which the compound or a precursor thereof is used at the time of silver halide grain formation.
3) A method of (1) above, in which the compound or a precursor thereof is used after completion of silver halide grain formation.
4) A method of (1) above, in which the compound is a compound represented by formula (I).
5) A method of (4) above, in which the adsorbable group in formula (I) is a mercapto group, a thione group or a group forming imino silver.
6) A method of (4) above, in which the adsorbable group is a mercapto group or a thione group.
7) A method of (4) above, in which the reducing group is a formyl group, an amino group or a hydrazino group.
8) A method of (1) above, in which the precursor of the compound (represented by formula (I)) is a compound producing a mercapto group.
9) A method of (5), (6), (7) or (8) above, in which the compound or a precursor thereof is used at the time of silver halide grain formation.
10) A method of (1) above, in which the compound or a precursor thereof photographic emulsion, in which the reduction sensitized silver halide photographic emulsion is further subjected to chalcogen sensitization selected from sulfur sensitization, selenium sensitization and tellurium sensitization.
11) A method of (1) above, in which the reduction sensitized silver halide photographic emulsion is further subjected to gold sensitization after the reduction sensitization.
12) A method of (1) above, in which the reduction sensitized silver halide photographic emulsion is further subjected to combined chemical sensitization consisting of chalcogen sensitization selected from sulfur sensitization, selenium sensitization and tellurium sensitization with gold sensitization.
13) A method of (1) above, in which the reduction sensitized silver halide photographic emulsion is further subjected to spectral sensitization by addition of a methine dye.
14) A method of (13) above, in which the methine dye is a cyanine dye.
15) A method of (1) above, in which the silver halide to be reduction sensitized is silver bromide, silver iodobromide, silver chloroiodobromide, silver chlorobromide or silver chloride, and the reduction sensitization is carried out at the time of grain formation.
16) A method of (1) above, in which the silver halide grains to be reduction sensitized are normal crystal grains (particularly regular crystal grains) or tabular grains.
17) A method of (1) above, in which the silver halide grains to be reduction sensitized have dislocation lines, and the reduction sensitization is carried out at the time of grain formation.
18) A silver halide photographic material containing at least one silver halide emulsion prepared by the method of (1) above.

EXAMPLE

The present invention will now be illustrated in greater detail with reference to Examples, but it should be understood that the present invention is not deemed to be limited thereto. Unless otherwise indicated, all the percents are by weight.

Example 1

Preparation of Emulsion Em-1

To 1 l of an aqueous solution (pH 6) containing 0.6 g of potassium bromide and 30 g of gelatin, kept at 75° C. under stirring, 75 ml of a 1M aqueous solution of silver nitrate and a 1M aqueous solution of potassium bromide were simultaneously added over a 4-minute period while maintaining the silver potential at 0 mV with reference to a saturated calomel electrode to form a core (first stage). Two minutes from the end of the addition, 675 ml of a 1M aqueous solution of silver nitrate and a 1M aqueous solution of potassium bromide were further added over a 36-minute period while maintaining the silver potential at 0 mV to form a shell (second stage). Five minutes from the completion of the grain formation, the temperature of the emulsion was dropped to 35° C., and the emulsion was desalted in a usual flocculation method and washed with water. Gelatin and water were added, and the pH and pAg were adjusted to 6.4 and of 8.6, respectively.

The resulting silver bromide emulsion, designated Em-1, was a mono-dispersed emulsion comprising octahedral grains having a diameter of 0.27 μm and a variation coefficient of grain diameter of 9%.

Preparation of Emulsions Em-2 to Em-23

Emulsions Em-2 to Em-23 were prepared in the same manner as for Em-1 except for adding the compound(s) shown in Table 1 below to the grain formation system one minute before the start of shell formation.

The resulting silver bromide emulsions were substantially equal to Em-1 in grain size, variation coefficient of grain diameter, and grain shape.

In the preparation of Em-6 and Em-10, sodium thiosulfonate ($C_2H_5SO_2Na$), a silver nuclei oxidizing agent, was added 6 minutes before the completion of the shell formation.

To each of the emulsions Em-1 to Em-23 were added gelatin, 4-hydroxy-6-methyl-1,3,3a,7-tetraazaindene, poly (sodium styrenesulfonate), phenoxyethanol, and sodium dodecylbenzenesulfonate to prepare a coating composition. The coating composition was applied to a triacetyl cellulose film support having a subbing layer together with a protective layer containing gelatin, polymethyl methacrylate particles, and sodium 2,4-dichloro-6-hydroxy-s-triazine by a co-extrusion method to give a coated sample (Sample Nos. 1 to 23).

Each sample was sensitometrically exposed for 10 seconds through an optical wedge, developed with an MAA-1 developer having the following formulation at 20° C. for 10 minutes, and then further processed in a conventional manner (stopping, fixing, washing, and drying).

The density was measured. A relative sensitivity was expressed in terms of reciprocal of an exposure necessary for obtaining an optical density of (fog value+0.2), taking the result of Sample 1 as a standard (100).

Formulation of MAA-1 Developer

| | |
|---|---|
| Metol | 2.5 g |
| Ascorbic acid | 10 g |
| NABOX | 35 g |
| Potassium bromide | 1 g |
| Water to make | 1 liter |

Further, each coated sample was preserved under a high temperature and high humidity condition (45° C. and 75% RH) for 5 days and processed in the same manner as described above to determine the relative sensitivity. The variation ratio of the resulting relative sensitivity to that of the same sample as determined immediately after preparation was obtained for evaluation of preservability.

In order to evaluate silver nuclei fog formed on the grain surface, each coated sample was immersed in a gold intensifier having the following formulation at 20° C. for 3 minutes and then washed with water for 30 minutes. The thus treated sample was developed with the MAA-1 developer at 20° C. for 10 minutes, and the fog was measured.

Formulation of Gold Intensifier (per liter of water)

| | |
|---|---|
| Chloroauric acid | 40 mg |
| Potassium thiocyanate | 0.5 g |
| Potassium bromide | 0.6 g |

TABLE 1

| Sample No. | Emulsion No. | Compound Added (mol/mol-Ag) | Immediately After Preparation: Fog | Immediately After Preparation: Relative Sensitivity | Rate of Sensitivity Reduction After Preservation (%) | Fog When Subjected to Gold Intensification | Remark |
|---|---|---|---|---|---|---|---|
| 1 | Em-1 | — | 0.03 | 100 | 81 | 0.05 | Comparison |
| 2 | Em-2 | Comparative Cpd. A* ($0.6 \times 10^{-6}$) | " | 447 | 65 | 0.10 | " |
| 3 | Em-3 | Comparative Cpd. A ($3 \times 10^{-6}$) | " | 570 | 59 | 0.26 | " |
| 4 | Em-4 | Comparative Cpd. A ($10 \times 10^{-6}$) | " | 708 | 54 | 0.85 | " |
| 5 | Em-5 | Comparative Cpd. A ($30 \times 10^{-6}$) | 0.04 | 804 | 50 | overall fog | " |
| 6 | Em-6 | Comparative Cpd. A ($10 \times 10^{-6}$) + $C_2H_5SO_2SNa$ ($3 \times 10^{-5}$) | 0.03 | 550 | 72 | 0.10 | " |
| 7 | Em-7 | Comparative Cpd. B** ($1.5 \times 10^{-5}$) | 0.03 | 645 | 55 | 0.41 | " |
| 8 | Em-8 | 1 ($10 \times 10^{-6}$) | 0.03 | 562 | 70 | 0.05 | Invention |
| 9 | Em-9 | 1 ($30 \times 10^{-6}$) | " | 631 | 65 | 0.10 | " |
| 10 | Em-10 | 1 ($30 \times 10^{-6}$) + $C_2H_5SO_2SNa$ ($1 \times 10^{-5}$) | " | 610 | 82 | 0.08 | " |
| 11 | Em-11 | 4 ($30 \times 10^{-6}$) | 0.03 | 479 | 78 | 0.06 | Invention |
| 12 | Em-12 | 6 ($30 \times 10^{-6}$) | " | 525 | 71 | 0.06 | " |
| 13 | Em-13 | 13 ($30 \times 10^{-6}$) | " | 450 | 82 | 0.06 | " |
| 14 | Em-14 | 15 ($10 \times 10^{-6}$) | " | 490 | 82 | 0.06 | " |
| 15 | Em-15 | 15 ($30 \times 10^{-6}$) | " | 510 | 79 | 0.08 | " |
| 16 | Em-16 | 16 ($10 \times 10^{-6}$) | " | 582 | 75 | 0.10 | " |

TABLE 1-continued

| Sample No. | Emulsion No. | Compound Added (mol/mol-Ag) | Immediately After Preparation: Fog | Immediately After Preparation: Relative Sensitivity | Rate of Sensitivity: Reduction After Preservation (%) | Fog When Subjected to Gold Intensification | Remark |
|---|---|---|---|---|---|---|---|
| 17 | Em-17 | 17 ($30 \times 10^{-6}$) | " | 479 | 81 | 0.06 | " |
| 18 | Em-18 | 21 ($3 \times 10^{-6}$) | " | 501 | 80 | 0.06 | " |
| 19 | Em-19 | 21 ($10 \times 10^{-6}$) | " | 631 | 65 | 0.13 | " |
| 20 | Em-20 | 22 ($30 \times 10^{-6}$) | " | 562 | 76 | 0.05 | " |
| 21 | Em-21 | 23 ($10 \times 10^{-6}$) | " | 438 | 85 | 0.05 | " |
| 22 | Em-22 | 24 ($3 \times 10^{-6}$) | " | 617 | 71 | 0.12 | " |
| 23 | Em-23 | 24 ($10 \times 10^{-6}$) | 0.04 | 724 | 65 | 0.32 | " |

Note:
Comparative Cpd. A: Aminoiminomethanesulfinic acid (i.e., thiourea dioxide)
Comparative Cpd. B: Dimethylamine borane As is apparent from the results of Table 1, although silver halide emulsions sensitized with Comparative Cpds. A and B, which are conventional reduction sensitizers of frequent use, show highly enhanced sensitivity, they undergo considerable decrease in sensitivity when preserved under a high temperature and high humidity condition and, when subjected to gold intensification, suffer from serious fog, producing a number of fog silver nuclei on the surface of the silver halide grains. A combination of thiosulfonic acid as oxidizing agent and these conventional reduction sensitizers improves preservability and suppresses fog but, in turn, reduces the increase of sensitivity that ought to have been achieved by reduction sensitization.

To the contrary, although the reduction sensitizers according to the present invention are slightly inferior to the known ones in terms of the degree of sensitivity enhancement, the emulsions sensitized with them undergo little change in sensitivity upon preservation and suffered little fog when subjected to gold intensification, even if an oxidizing agent is not used in combination. Further, addition of a reduced amount of an oxidizing agent, if used in combination, is enough to produce the desired effects.

Example 2

Preparation of Emulsion Em-31

Ten grams of potassium bromide, 0.4 g of potassium iodide, and 15 g of inert gelatin having an average molecular weight of 15000 were dissolved in 3.7 l of distilled water. A 14% aqueous solution of potassium bromide and a 20% aqueous solution of silver nitrate were added to the obtained aqueous solution while stirring at constant rates over 15 seconds at 55° C. and at a pBr of 1.0 according to a double jet process (first stage; by this addition, 5.5% of the total silver amount was consumed).

A 17% aqueous solution (300 cc) of gelatin was added thereto, followed by stirring at 55° C., and a 20% aqueous solution of silver nitrate was added thereto at a constant rate until the pBr reached 1.4 (second stage; by this addition, 5.0% of the total silver amount was consumed). Further, a 20% aqueous solution of potassium bromide ($KBr_{1-x}I_x$, x=0.04) and a 33% aqueous solution of silver nitrate were added over 43 minutes according to a double jet process (third stage; by this addition, 25% of the total silver amount was consumed). An aqueous solution containing 4.5 g of potassium iodide was added, 14.5 ml of a 0.01% aqueous solution of $K_3IrCl_6$ was added, and a mixed aqueous solution containing a 18% aqueous solution of potassium bromide and a 3% aqueous solution of potassium iodide and a 33% aqueous solution of silver nitrate were then added over 39 minutes according to a double jet process (fourth stage; by this addition, 64.5% of the total silver amount was consumed). The total amount of silver nitrate used for the emulsion was 425 g. The emulsion was desalted by a conventional flocculation method. Gelatin and water were added, and the emulsion was adjusted to a pAg of 8.2 and a pH of 5.8 at 40° C. There was thus prepared a tabular silver iodobromide emulsion in which tabular grains having an aspect ratio of 5 or more occupied 50% of the total projected area, tabular grains having an aspect ratio of 2 or more occupied 90% of the total projected area (average aspect ratio: 6.0), and the silver halide grains had a variation coefficient of grain size of 18% and a sphere-equivalent diameter (i.e., a circle-corresponding diameter) of 0.6 μm. Observation under a 200 kV transmission electron microscope at a liquefied $N_2$ temperature revealed that grains having 50 or more dislocation lines per grain occupied 60%.

The resulting emulsion was heated to 56° C., and a sensitizing dye, anhydro-5-chloro-5'-phenyl-9-ethyl-3,3'-di(3-sulfopropyl)oxacarbocyanine hydroxide sodium salt, was added thereto. Chloroauric acid ($1.8\times10^{-5}$ mol/mol-Ag), sodium thiosulfate ($2.8\times10^{-5}$ mol/mol-Ag), pentafluorophenyl diphenylphosphine selenide ($1.0\times10^{-5}$ mol/mol-Ag), and potassium thiocyanate ($2\times10^{-3}$ mol/mol-Ag) were added to the emulsion, followed by ripening for 45 minutes.

Preparation of Emulsion Em-32

Emulsion Em-32 was prepared in the same manner as for Em-31 except for adding the reduction sensitizer of the present invention as shown in Table 2 below immediately before the start of the fourth stage.

The resulting emulsion was equal to Em-31 in grain size, grain shape, and the like.

To each of Em-31 and Em-32 were added a magenta coupler (3-{3-[2-(2,4-di-t-amylphenoxy)butyrylamino]benzoylamino}-1-(2,4,6-trichlorophenyl)pyrazolin-5-one), an oil (tricresyl phosphate), a stabilizer (4-hydroxy-6-methyl-1,3,3a,7-tetraazaindene), an antifoggant (1-(m-sulfophenyl)-5-mercaptotetrazole monosodium salt and 1-(p-carboxyphenyl)-5-mercaptotetrazole), a coating aid (sodium dodecylbenzenesulfonate), a hardening agent (1,2-bis(vinylsulfonylacetylamino)ethane), and an antiseptic (phenoxyethanol) to prepare a coating composition. The coating composition and a gelatin protective layer containing polymethyl methacrylate fine particles were applied to a triacetyl cellulose film support having a subbing layer by co-extrusion.

Each coated sample was sensitometrically exposed through a yellow filter for 1/100 second and subjected to color development processing according to the following schedule.

Processing Schedule

| Step | Time | Temp. |
|---|---|---|
| Color development | 2'45" | 38° C. |
| Bleaching | 6'30" | 38° C. |
| Washing | 2'10" | 24° C. |
| Fixing | 4'20" | 38° C. |
| Washing (1) | 1'05" | 24° C. |
| Washing (2) | 1'00" | 24° C. |
| Stabilization | 1'05" | 38° C. |
| Drying | 4'20" | 55° C. |

Formulation of Processing Solutions

| | |
|---|---|
| Color Developer: | |
| Diethylenetriaminepentaacetic acid | 1.0 g |
| 1-Hydroxyethylidene-1,1-diphosphonic acid | 3.0 g |
| Sodium sulfite | 4.0 g |
| Potassium carbonate | 30.0 g |
| Potassium bromide | 1.4 g |
| Potassium iodide | 1.5 mg |
| Hydroxylamine sulfate | 2.4 g |
| 4-(N-Ethyl-N-β-hydroxyethylamino)-2-methylaniline sulfate | 4.5 g |
| Water to make | 1.0 liter |
| pH | 10.05 |
| Bleaching Solution: | |
| Sodium (ethylenediaminetetraacetato)-iron (III) trihydrate | 100.0 g |
| Disodium ethylenediaminetetraacetate | 10.0 g |
| Ammonium bromide | 140.0 g |
| Ammonium nitrate | 30.0 g |
| Aqueous ammonia (27%) | 6.5 ml |
| Water to make | 1.0 liter |
| pH | 6.0 |
| Fixer: | |
| Disodium ethyelnediaminetetraacetate | 0.5 g |
| Sodium sulfite | 7.0 g |
| Sodium bisulfite | 5.0 g |
| Aqueous solution of ammonium thiosulfate (70%) | 170.0 ml |
| Water to make | 1.0 liter |
| pH | 6.7 |
| Stabilizer: | |
| Formalin (37%) | 2.0 ml |
| Polyoxyethylene-p-monononylphenyl ether (average degree of polymerization: 10) | 0.3 g |
| Disodium ethylenediaminetetraacetate | 0.05 g |
| Water to make | 1.0 liter |
| pH | 5.0–8.0 |

The density of the processed sample was measured through a green filter. The photographic properties of the samples are shown in Table 2. The relative sensitivity is a reciprocal of an exposure necessary for obtaining an iptical density of (fog value+maximum density/2), expressed relatively taking the result of Sample 3 as a standard (100).

TABLE 2

| Sample No. | Emulsion | Compound Added | Fog | Relative Sensitivity | Remark |
|---|---|---|---|---|---|
| 31 | Em-31 | — | 0.18 | 100 | Comparison |
| 32 | Em-32 | Compound 1 ($5 \times 10^{-5}$ mol/mol-Ag) | 0.20 | 137 | Invention |

As is apparent from the results of Table 2, appreciable sensitization was achieved without involving serious fog by using the reduction sensitizer of the present invention.

Example 3

An aqueous solution containing 18 g of silver nitrate and an aqueous solution containing 12.7 g of potassium bromide were simultaneously added over a 20-minute period to 1 liter of an aqueous solution containing 0.35 g of potassium bromide and 40 g of gelatin (pH 5.0) kept at 75° C. while stirring. An aqueous solution containing 156 g of silver nitrate and a 140 g/l aqueous solution of potassium bromide were added thereto simultaneously over 20 minutes each at such a feeding rate that the final rate was 5.4 times the initial one. During the addition, the silver potential was kept at −25 mV with reference to a saturated calomel electrode.

After completion of grain formation, the emulsion was desalted by a conventional flocculation method and washed with water. Gelatin and water were added thereto, and the emulsion was adjusted to a pH of 6.3 and a pAg of 8.3. The resulting silver bromide emulsion comprised monodispersed octahedral grains having a grain diameter of 0.45 μm and a variation coefficient of grain diameter of 8.5%.

The emulsion was divided into portions. The sensitizer shown in Table 3 below was added to each portion, followed by ripening for 60 minutes.

A coated sample was prepared using the resulting emulsion and processed in the same manner as in Example 1. Another set of coated samples was subjected to gold intensification in the same manner as in Example 1.

The relative sensitivity was relatively expressed in terms of a reciprocal of an exposure necessary for obtaining an optical density of (fog value+0.2), taking the result of Sample 41 as a standard (100).

TABLE 3

| Sample No. | Compound Added (mol/mol-Ag) | Immediate After Preparation: Fog | Immediate After Preparation: Relative Sensitivity | Fog When Subjected to Gold Intensification | Remark |
|---|---|---|---|---|---|
| 41 | — | 0.03 | 100 | 0.06 | Comparison |
| 42 | Comparative Cpd. A* ($2 \times 10^{-6}$) | 0.03 | 251 | 0.18 | " |
| 43 | Comparative Cpd. A ($8 \times 10^{-6}$) | " | 282 | 0.96 | " |
| 44 | Comparative Cpd. A ($32 \times 10^{-6}$) | 0.04 | 380 | overall fog | " |
| 45 | 1 ($8 \times 10^{-6}$) | 0.03 | 263 | 0.12 | Invention |
| 46 | 1 ($32 \times 10^{-6}$) | " | 302 | 0.26 | " |
| 47 | 5 ($8 \times 10^{-6}$) | " | 245 | 0.08 | " |
| 48 | 5 ($32 \times 10^{-6}$) | " | 263 | 0.14 | " |
| 49 | 9 ($4 \times 10^{-6}$) | " | 257 | 0.12 | " |
| 50 | 9 ($16 \times 10^{-6}$) | " | 275 | 0.14 | " |
| 51 | 16 ($4 \times 10^{-6}$) | " | 269 | 0.10 | " |
| 52 | 16 ($16 \times 10^{-6}$) | " | 288 | 0.16 | " |
| 53 | 17 ($16 \times 10^{-6}$) | " | 240 | 0.08 | " |
| 54 | 17 ($64 \times 10^{-6}$) | " | 261 | 0.09 | " |
| 55 | 21 ($8 \times 10^{-6}$) | " | 275 | 0.11 | " |
| 56 | 21 ($32 \times 10^{-6}$) | " | 288 | 0.24 | " |

Note:
*Comparative Cpd. A: the same as in Example 1.

As is apparent from the results of Table 3, a conventionally well-known reduction sensitizer achieves satisfactory sensitization but causes considerable fog in gold intensification even when added after silver halide grain formation.

On the other hand, while the reduction sensitizers of the present invention are inferior in degree of sensitivity enhancement with the amount added being the same, the fog resulting from gold intensification is very small with the degree of sensitivity enhancement being the same.

Where the reduction sensitizer of the present invention is added in a large amount, the change in sensitivity increase is relatively small even if the amount of the reduction sensitizer is somewhat varied. That is, if it is added in a large amount, the increase of fog is suppressed, which means excellent reproducibility of the reduction sensitizer.

Example 4

To an aqueous solution containing potassium bromide, thioether ($HO(CH_2)_2S(CH_2)_2S(CH_2)OH$) and gelatin which was kept at 70° C. under stirring, a silver nitrate aqueous solution and a mixed aqueous solution of potassium iodide and potassium bromide were added according to a double jet process.

After the addition, the emulsion was cooled to 35° C., desalted by a conventional flocculation method, and washed with water. Gelatin and water were added thereto, and the pH and pAg were adjusted to 6.8 and 8.4, respectively.

The resulting tabular silver halide grains had an average diameter of 1.15 μm, an average thickness of 0.15 μm, an average diameter/thickness ratio of 7.7, and a silver iodide content of 0.5 mol%.

The emulsion was divided into portions and heated to 62° C., and the sensitizer shown in Table 4 was added to each portion. After 30 minutes, 500 mg/mol-Ag of a sensitizing dye, anhydro-5,5'-dichloro-9-ethyl-3,3'-di(3-sulfopropyl) oxacarbocyanine hydroxide sodium salt, and 100 mg/mol-Ag of potassium iodide were added. To the emulsion were further added $7\times10^{-6}$ mol/mol-Ag of chloroauric acid, $1.8\times10^{-5}$ mol/mol-Ag of sodium thiosulfate, $1\times10^{-5}$ mol/mol-Ag of triphenylphosphine selenide, and $3.2\times10^{-4}$ mol/mol-Ag of potassium thiocyanate, followed by ripening for 30 minutes.

Thereafter, 4-hydroxy-6-methyl-1,3,3a,7-tetraazaindene, sodium polystyrenesulfonate, sodium dodecylbenzenesulfonate, sodium 2,4-dichloro-6-hydroxy-s-triazine, and phenoxyethanol were added to the emulsion, and the resulting coating composition was applied to a polyethylene terephthalate film support together with a gelatin protective layer containing polymethyl methacrylate particles by co-extrusion.

The resulting coated sample was exposed to light through a yellow filter and an optical wedge for 1/100 seconds, developed with RD-III (a developer designed for automatic developing machine, produced by Fuji Photo Film Co., Ltd.) at 35° C. for 30 seconds, and fixed, washed and dried in a conventional manner. The optical density was measured.

The photographic sensitivity was relatively expressed in terms of a reciprocal of an exposure necessary for obtaining an optical density of (fog value+0.5), taking the result of Sample 61 as a standard (100). The results obtained are shown in Table 4.

TABLE 4

| Sample No. | Compound Added (mol/mol-Ag) | Fog | Relative Sensitivity | Remarks |
|---|---|---|---|---|
| 61 | — | 0.10 | 100 | Comparison |
| 62 | Comparative Cpd. B* ($8\times10^{-7}$) | 0.26 | 118 | " |
| 63 | 1 ($4\times10^{-6}$) | 0.12 | 115 | Invention |
| 64 | 16 ($3\times10^{-6}$) | 0.12 | 118 | " |
| 65 | 21 ($3\times10^{-6}$) | 0.14 | 121 | " |

*Comparative Cpd. B: the same as in Example 1.

As is apparent from the results in Table 4, a well-known reduction sensitizer brings about increased sensitivity but causes considerable fog. In the case of using the reduction sensitizer according to the present invention, although it should be used in an increased amount in order to achieve the same level of sensitization as obtained with the conventional one, occurrence of fog can be suppressed.

Example 5

A coated sample was prepared in the same manner as for Sample 6 of Example 3 of JP-A-6-258788 (Sample No. 101), except for using Em-32 as prepared in Example 2 in the 5th layer. As a result of the same processing as in that Example, satisfactory photographic properties were secured.

Example 6

A coated sample was prepared in the same manner as for Light-sensitive Material X of Example 1 of JP-A-6-273860, except for using Em-32 as prepared in Example 2. When the sample was processed using Screen B in the same manner as in that Example, satisfactory photographic properties were obtained.

While the invention has been described in detail and with reference to specific embodiments thereof, it will be apparent to one skilled in the art that various changes and modifications can be made therein without departing from the spirit and scope thereof.

What is claimed is:

1. A method of reduction sensitization of a silver halide photographic emulsion, comprising using a reduction sensitizer comprising a compound having a group which is capable of being adsorbed onto a silver halide and a reducing group or a precursor of said compound wherein said compound is represented by formula (I):

$$A-(W)_n-R \quad (I)$$

wherein A represents an atomic group containing a mercapto group, a thione group or a group which forms imino silver; W represents a divalent linking group; n represents 0 or 1; and R represents a formyl group, an amino group or an acetylene group.

2. The method as claimed in claim 1, wherein said compound or a precursor thereof is used during silver halide grain formation.

3. The method as claimed in claim 1, wherein said compound or a precursor thereof is used after completion of silver halide grain formation.

4. The method of claim 1 wherein the reduction sensitizer is used in an amount of $1\times10^{-7}$–$1\times10^{-3}$ mol/mol of silver halide.

5. The method of claim 1 wherein A is selected from the group consisting of a mercaptotetrazole group, a mercaptotriazole group, a mercaptoimidazole group, a mercaptothiadiazole group, mercaptoxadiazole group, a mercaptobenzothiazole group, a mercaptobenzoxazole group, a mercaptobenzimidazole group, a mercaptotetraazaindene group, a mercaptopyridyl group, a mercaptoalkyl group, a mercaptophenyl group, a thiazoline-2-thione group, an imidazoline-2-thione group, a benzimidazoline-2-thione group, benzothiazoline-2-thione group, a thiourea group, a thioamido group, a benzotriazole group, a tetrazole group, hydroxytetraazaindene group, and a benzimidazole group.

6. The method of claim 1 wherein W is selected from the group consisting of an alkylene group having 1–20 carbon atoms, an arylene group having 6–20 carbon atoms, $—CONR_1—$, $—SO_2NR_2—$, —O—, —S—, $—NR_3$, $—NR_4CO—$, $—NR_5SO_2—$, $—NR_6CONR_7—$, —COO— and —OCO—, wherein $R_1$–$R_7$ each represent a hydrogen atom, an aliphatic group or an aromatic group.

7. The method of claim 1 wherein said compound or said precursor is selected from the group consisting of:

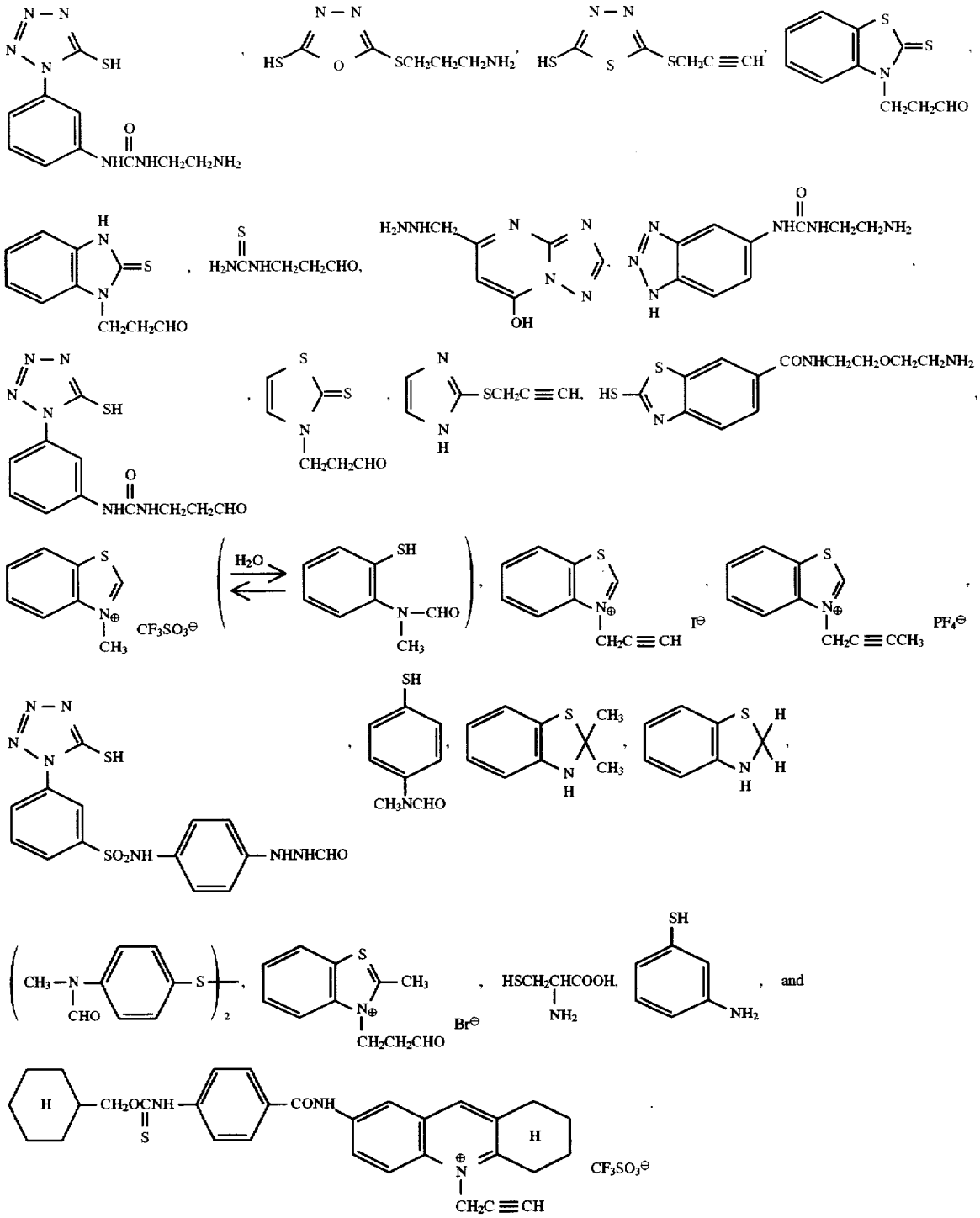
8. A silver halide photographic material containing at least one silver halide emulsion which is prepared by the reduction sensitization method of claim 1.
* * * * *